US007161340B2

(12) United States Patent
Chiu

(10) Patent No.: US 7,161,340 B2
(45) Date of Patent: Jan. 9, 2007

(54) METHOD AND APPARATUS FOR GENERATING N-ORDER COMPENSATED TEMPERATURE INDEPENDENT REFERENCE VOLTAGE

(75) Inventor: Yung-Ming Chiu, Taipei (TW)

(73) Assignee: Realtek Semiconductor Corp., HsinChu (TW)

( * ) Notice: Subject to any disclaimer, the term of this patent is extended or adjusted under 35 U.S.C. 154(b) by 135 days.

(21) Appl. No.: 10/710,438

(22) Filed: Jul. 12, 2004

(65) Prior Publication Data

US 2006/0006858 A1 Jan. 12, 2006

(51) Int. Cl.
*G05F 3/16* (2006.01)

(52) U.S. Cl. ..... 323/313; 323/16; 323/907

(58) Field of Classification Search ..... 323/313, 323/314, 315, 316, 907
See application file for complete search history.

(56) References Cited

U.S. PATENT DOCUMENTS 4,622,512 A * 11/1986 Brokaw ..... 323/313
6,111,397 A * 8/2000 Leung ..... 323/315
6,124,704 A * 9/2000 Annema ..... 323/313
6,133,718 A * 10/2000 Calafato et al. ..... 323/312
6,181,121 B1 * 1/2001 Kirkland et al. ..... 323/313
6,566,849 B1 * 5/2003 Chavan et al. ..... 323/312
6,937,001 B1 * 8/2005 Ueda ..... 323/313

OTHER PUBLICATIONS

Chris Toumazou, George Moschytz and Barrie Gilbert; "Trade-Offs in Analog Circuit Design"; Kluwer Academic Publishers; ISBN1-4020-7037-3, 2002.

* cited by examiner

*Primary Examiner*—Jeffrey Sterrett
(74) *Attorney, Agent, or Firm*—Winston Hsu

(57) ABSTRACT

A reference voltage generator includes a plurality of signal generators for producing N+1 signals respectively corresponding to N+1 temperature dependent characteristics, a combining module coupled to the signal generators for combining the N+1 signals to form a combined signal, and a signal to voltage converter coupled to the combining module for generating a compensated reference voltage according to the combined signal. The signal generators include N+1 devices having p-n junctions and each device has a specific temperature dependent characteristic corresponding to the voltage across a p-n junction, such as the base-emitter voltage of a transistor. By scaling the N+1 signals, a reference voltage at a predetermined value is generated and has $N^{th}$ order temperature compensation.

21 Claims, 5 Drawing Sheets

METHOD AND APPARATUS FOR GENERATING N-ORDER COMPENSATED TEMPERATURE INDEPENDENT REFERENCE VOLTAGE

BACKGROUND OF INVENTION

1. Field of the Invention

The invention relates to electronic circuits, and more particularly, to generating a constant reference voltage having $N^{th}$ order temperature compensation.

2. Description of the Prior Art

Bandgap voltage reference circuits are widely used in various applications in order to provide a stable voltage reference over a temperature range. The bandgap voltage reference circuit operates on the principle of compensating the negative temperature coefficient of a base-emitter junction voltage, $V_{BE}$, with the positive temperature coefficient of the thermal voltage $V_T$, with $V_T$ being equal to kT/q. Typically, the variation of $V_{BE}$ with temperature is approximately 1.5 mV/° C., while $V_T$ is approximately +0.086 mV/° C. These terms are combined to generate the bandgap voltage, $V_{BG}$:

$$V_{BG} = K_1 V_{BE} + K_2 V_T \quad \text{Eq. (1)}$$

where $K_1$ and $K_2$ are proportionality constants to ensure that the positive and negative thermal factors cancel one another, and, optionally, to scale the bandgap voltage to accommodate application requirements.

FIG. 1 is a circuit diagram showing a typical bandgap voltage reference circuit 100. The bandgap voltage reference circuit 100 includes PMOS transistors M1, M2 and M3, bipolar transistors Q1 (having emitter area KA) and Q2 (having emitter area A), resistors R0, R1, R2 and R3, and an operational amplifier (Op-amp) 101. Please note that here, in FIG. 1, the resistors R1 and R2 are of the same value. Transistors Q1 and Q2 conduct substantially equal currents. Because the ratio of the emitter areas of transistors Q1 and Q2 is K:1, a . $V_{BE}$, of substantially $V_T$In(K), is produced across resistor R0, providing a proportional-to-absolute-temperature current. The Op-amp 101 forces the voltages at nodes $V_1$ and $V_2$ to be equal, thereby causing currents to flow in resistors R1 and R2 which are proportional to $V_{BE}$ and providing a complementary-to-absolute-temperature current. The resulting current through transistors M1 and M2 is thus compensated in accordance with Equation (1). The compensated current is mirrored to transistor M3 to generate the output voltage $V_{out}$.

Specifically, in the bandgap reference circuit 100 of FIG. 1, the output voltage $V_{OUT}$ is defined by Equation (2):

$$V_{OUT} = \frac{R3}{R1} V_{BE2} + \frac{R3}{R0} V_T \ln(K), \quad \text{Eq. (2)}$$

where $V_{BE2}$ is the base-emitter voltage of transistor Q2 and K is the area ratio of transistors Q1 and Q2. Comparing Equation (2) with Equation (1), it is clear that the values of resistors R0, R1 and R3, and the emitter areas of transistors Q1 and Q2 are selected to provide the desired proportionality constants $K_1$ and $K_2$. For any area ratio of transistors Q1 and Q2, it can be shown using Equation (2) that when the resistor values are selected to ensure the positive and negative thermal factors canceling one another, the bandgap reference circuit 100 generates a constant reference voltage $V_{OUT}$.

However, this constant reference voltage $V_{OUT}$ is only accurate at a specific center temperature. As the temperature of the bandgap reference circuit 100 deviates from the center temperature, there is a significant voltage change in the reference voltage $V_{OUT}$. For example, over a temperature range from −40° C. to +100° C., a voltage change of approximately 1 mV is typical.

SUMMARY OF INVENTION

One objective of the claimed invention is therefore to provide an $N^{th}$ order compensated temperature independent voltage reference generator.

According to embodiments of the present invention, a reference voltage generator having $N^{th}$ order temperature compensation is disclosed. The reference voltage generator comprises: a plurality of signal generators for producing a plurality of signals respectively corresponding to a plurality of temperature dependent characteristics; a combining module coupled to the signal generators for combining the plurality of signals to form a combined signal; and a signal to voltage converter coupled to the combining module for generating a compensated reference voltage according to the combined signal.

According to embodiments of the present invention, a method for generating a reference voltage having $N^{th}$ order temperature compensation is also disclosed. The method comprises: producing a plurality of signals respectively corresponding to a plurality of temperature dependent characteristics; combining the plurality of signals to form a combined signal; and generating a compensated reference voltage according to the combined signal.

These and other objectives of the claimed invention will no doubt become obvious to those of ordinary skill in the art after reading the following detailed description of the embodiments that are illustrated in the various figures and drawings.

DETAILED DESCRIPTION

Figure 1:
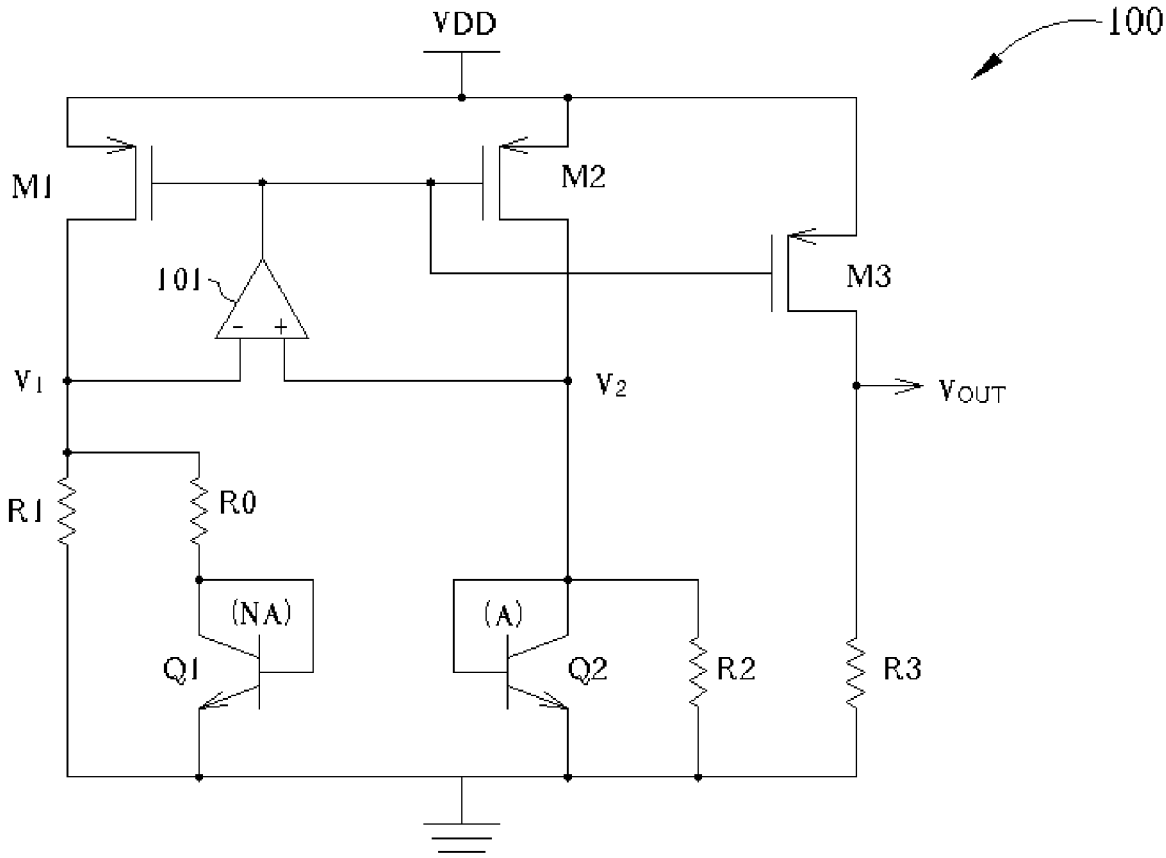
Fig. 1 Prior art
FIG. 1 is a circuit diagram showing a typical bandgap voltage reference circuit.

As temperature changes, the typical bandgap reference circuit 100 shown in FIG. 1 has a variation in the output voltage $V_{OUT}$ primarily because the bandgap reference circuit 100 achieves only $1^{st}$ order temperature compensation. The reason the bandgap reference circuit is only $1^{st}$ order compensated for temperature is because only two base-emitter voltages (Q1 and Q2) are used.

In order to produce a constant reference voltage having $2^{nd}$ order compensation for temperature changes, at least three different temperature dependent characteristics, such as base-emitter voltages, need to be used. To explain $2^{nd}$ order compensation, Equation (3) shows a Taylor series representation of the resultant output reference voltage $V_{REF}$.

$$V_{REF} = K_1 V_{BE1} + K_2 V_{BE2} + K_3 V_{BE3} = r_0 + r_1(T - Tr) + r_2(T - Tr)^2 + \ldots \quad \text{Eq. (3)}$$

$$V_{REF} \approx K_1(\beta_{1,0} + \beta_{2,0}(T - Tr) + \beta_{3,0}(T - Tr)^2 + \ldots) + K_2(\beta_{1,1} + \beta_{2,1}(T - Tr) + \beta_{3,1}(T - Tr)^2 + \ldots) + K_3(\beta_{1,2} + \beta_{2,2}(T - Tr) + \beta_{3,2}(T - Tr)^2 + \ldots) \quad \text{Eq. (4)}$$

Therefore $$r_0 = K_1\beta_{10} + K_2\beta_{2,0} + K_3\beta_{3,0} \quad \text{Eq. (5, 6, 7)}$$

$$r_1 = K_1\beta_{1,1} + K_2\beta_{2,1} + K_3\beta_{3,1}$$

$$r_2 = K_1\beta_{1,2} + K_2\beta_{2,2} + K_3\beta_{3,2}$$

where, for $2^{nd}$ order compensation, $r_1$ and $r_2$ are equal to zero. Generalizing for $N^{th}$ order compensation, at least N+1 different temperature dependent characteristics, such as base-emitter voltages, need to be used, and $r_1$ to $r_N$ are equal to zero.

Figure 2:
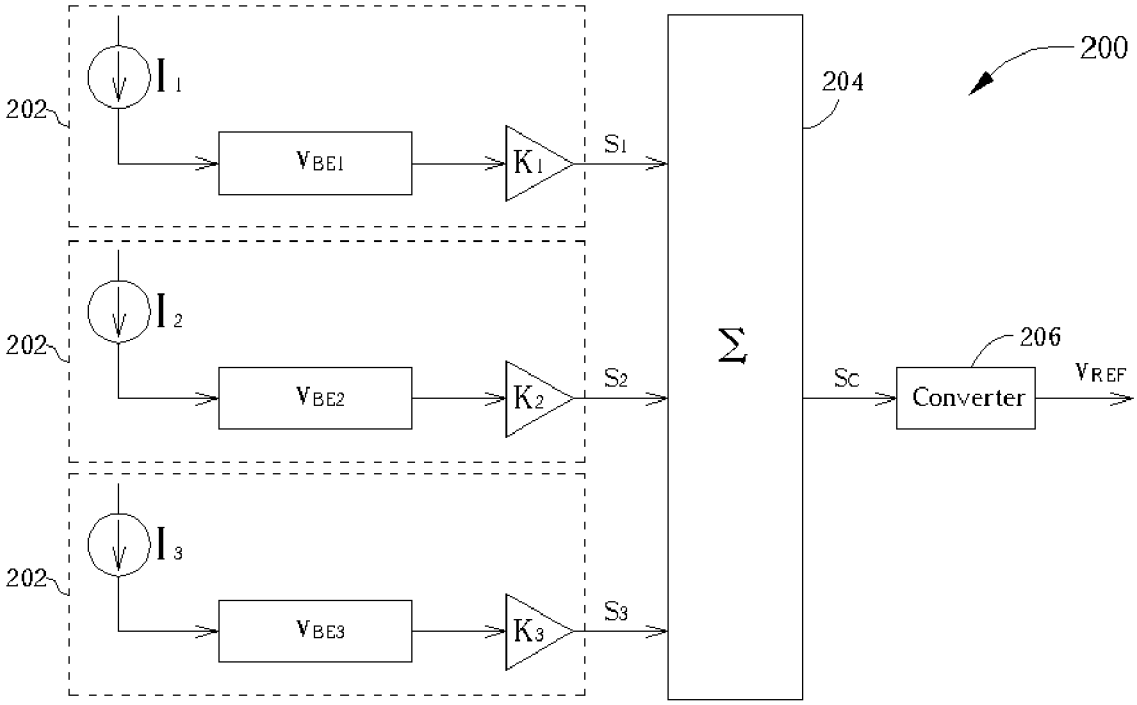
FIG. 2 shows a block diagram of a $2^{nd}$ order compensated reference voltage generator according to an embodiment of the present invention.

FIG. 2 shows a block diagram of a $2^{nd}$ order compensated reference voltage generator 200 according to an embodiment of the present invention. The $2^{nd}$ order compensated reference voltage generator 200 includes a plurality of signal generators 202, a combining module 204, and a signal to voltage converter 206. The signal generators 202 respectively generate signals $S_1$, $S_2$, $S_3$ corresponding to unique base-emitter junctions of bipolar junction transistors. As an example, in FIG. 2, each signal generator 202 is shown having a current source $I_1$, $I_2$, $I_3$; a base-emitter junction $V_{BE1}$, $V_{BE2}$, $V_{BE3}$; and a scaling device for scaling the signal by a scaling factor $K_1$, $K_2$, $K_3$. The combining module receives the signals $S_1$, $S_2$, $S_3$ and electrically adds or subtracts the signal $S_1$, $S_2$, $S_3$ to form a combined signal $S_C$. The signal to voltage converter generates a reference voltage $V_{REF}$ according to the combined signal $S_C$. By selecting appropriate scaling factors $K_1$, $K_2$, $K_3$ to satisfy Equation (3) with $r_1$ and $r_2$ being equal to zero and the thermal factors (base-emitter voltages) canceling each other, the reference voltage $V_{REF}$ generated by the voltage generator 200 is a constant predetermined value having $2^{nd}$ order compensation for temperature. Additionally, the value $V_{REF}$ can be determined by the scale factors $K_1$, $K_2$, $K_3$, and a scale factor associated with the converter 206.

Figure 3:
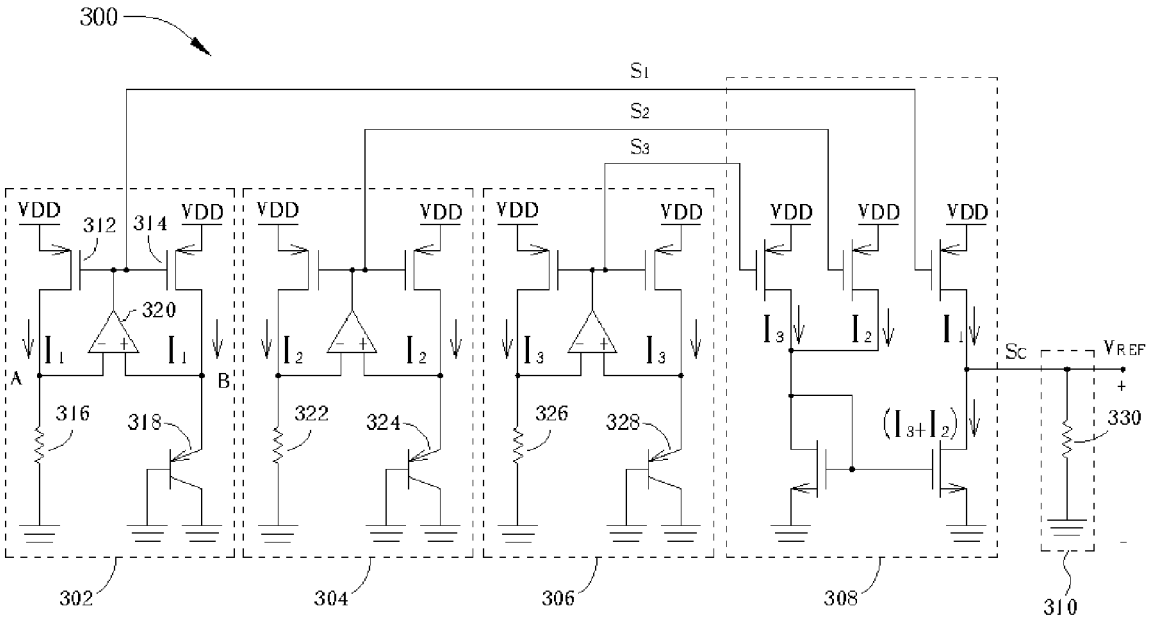
FIG. 3 shows a first circuit diagram for a $2^{nd}$ order compensated reference voltage generator according to a first embodiment of the present invention.

FIG. 3 shows a first circuit diagram for a $2^{nd}$ order compensated reference voltage generator 300 according to a first embodiment of the present invention. The reference voltage generator 300 includes a first signal generator 302, a second signal generator 304, a third signal generator 306, a combining module 308, and a signal to voltage converter 310. The first signal generator 302 includes first and second PMOS transistors 312, 314, a resistor 316, a bipolar transistor 318, and an operational amplifier (op-amp) 320. The first and second PMOS transistors 312, 314 act as current sources and generate substantially equal currents I1 according to the output of the op-amp 320. The op-amp 320 ensures that the voltage at nodes A and B are equivalent. The voltage at nodes A and B is therefore the base-emitter voltage $V_{BE}$ of the bipolar transistor 318 and depends on the emitter area of the bipolar transistor 318 and the current I1. By selecting the value of the resistor 316, the current $I_1$ can be appropriately scaled. The output signal $S_1$ of the first signal generator 302 is the output of the op-amp 320, which is effectively a control signal controlling the amount of current generated by the first and second PMOS transistors 312, 314. The second and third signal generators 304, 306 are structurally similar to the first signal generator, but have different bipolar transistor 324, 328 emitter areas and different resistor 322, 326 values, and, therefore, produce differently scaled output signals S2, S3, respectively.

The combining module 308 uses the signals S1, S2, S3 and a plurality of PMOS and NMOS transistors to reproduce the currents $I_1$, $I_2$, $I_3$ from the first, second, and third signal generators 302, 304, 306, respectively. The three currents $I_1$, $I_2$, $I_3$ are then combined such that $S_C$ is equal to $I_1$ $I_3$ $I_2$. The signal to voltage converter 310 simply couples this combined current signal $S_C$ outputted by the combining module 308 to ground using an output resistor 330. By selecting the emitter areas of the first, second, and third bipolar transistors 318, 324, 328 and the values of the resistors 316, 322, 326, 330, the value of $V_{REF}$ can be fixed at a predetermined value independent of temperature having $2^{nd}$ order temperature compensation.

Please note that, by observing the combining module 308 of this embodiment, the combining module 308 comprises a number of transistors, each of which respectively forms a current mirror configuration in conjunction with transistors in each of the signal generators 302, 304, 306, through the communication of the signals S1, S2, S3. Although in this embodiment the currents generated by the transistors in the combining module 308 are respectively equal to those in the corresponding signal generators, it is well known that they can be scaled by properly designing the area ratio between the transistor in the combining module 308 and the transistor in the signal generator constituting a current mirror pair. Then such currents in the combining module 308 are combined, in this embodiment, using another current mirror. In other words, the combining module 308 arithmetically combines a plurality of currents according to the plurality of signals S1, S2, S3, to render the combined current signal $S_C$.

In order to determine the specific resistor values, the following procedure can be used. First choose a ratio among the emitter areas of the three bipolar transistors 318, 324, 328. In the following example, assume the ratio among the emitter areas of the three bipolar transistors 318, 324, 328 is equal to 3:45:1, and the currents flowing through the transistors are the same. Next, use a simulation tool or experimental results to determine the dependence on temperature of the three emitter-base voltages $V_{BE1}$, $V_{BE2}$, $V_{BE3}$ for the three bipolar transistors 318, 324, 328, respectively. For example, for a center temperature value $T_r$ of 40° C.:

$$V_{BE1}=748.6218\ 1.7308(T-T_r)\ 0.0006(T-T_r)^2$$

$$V_{BE2}=651.7201\ 2.0533(T-T_r)\ 0.0007(T-T_r)^2$$

$$V_{BE3}=760.4482\ 1.6918(T-T_r)\ 0.0006(T-T_r)^2$$

Using Equation (8) shown below, the ratios between the resistance values $R_1$, $R_2$, $R_3$, $R_4$ of the resistors 316, 322, 326, 330 can be determined where $r_1=r_2=0$ for $2^{nd}$ order temperature compensation.

$$\begin{aligned} V_{REF} &= K_1 V_{BE1} + K_2 V_{BE2} + K_3 V_{BE3} \\ &= R_4\left(\frac{V_{BE1}}{R_1} - \frac{V_{BE3}}{R_3} - \frac{V_{BE2}}{R_2}\right. \\ &= r_0 + r_1(T - Tr) + r_2(T - Tr)^2 + \ldots \end{aligned} \quad \text{Eq. (8)}$$

For low power consumption, large resistor values can be chosen. Continuing the above example, in order to generate a reference voltage at 700 mV, after calculation, the following resistor values are determined:

First resistor 316=24.52 k

Second resistor 322=50 k

Third resistor 326=57.3 k

Output resistor 330=200 k

According to this embodiment, the actual value of the reference voltage $V_{REF}$ is determined according to the scaling factors (resistors 316, 322, 326, 330) used in the signal generators 302, 304, 306 and the signal to voltage converter 310, respectively. In this way, reference voltage $V_{REF}$ with an even smaller value can be generated. The reference voltage $V_{REF}$ has $N^{th}$ order temperature compensation so is more accurate than the prior art $1^{st}$ order bandgap reference circuit 100. Additionally, reference voltage $V_{REF}$ values lower than 1.2V can be generated, therefore, the present invention bandgap reference circuit can be used in very low supply-voltage circuits, for example, sub 1.5V power rail VDD applications.

Figure 4:
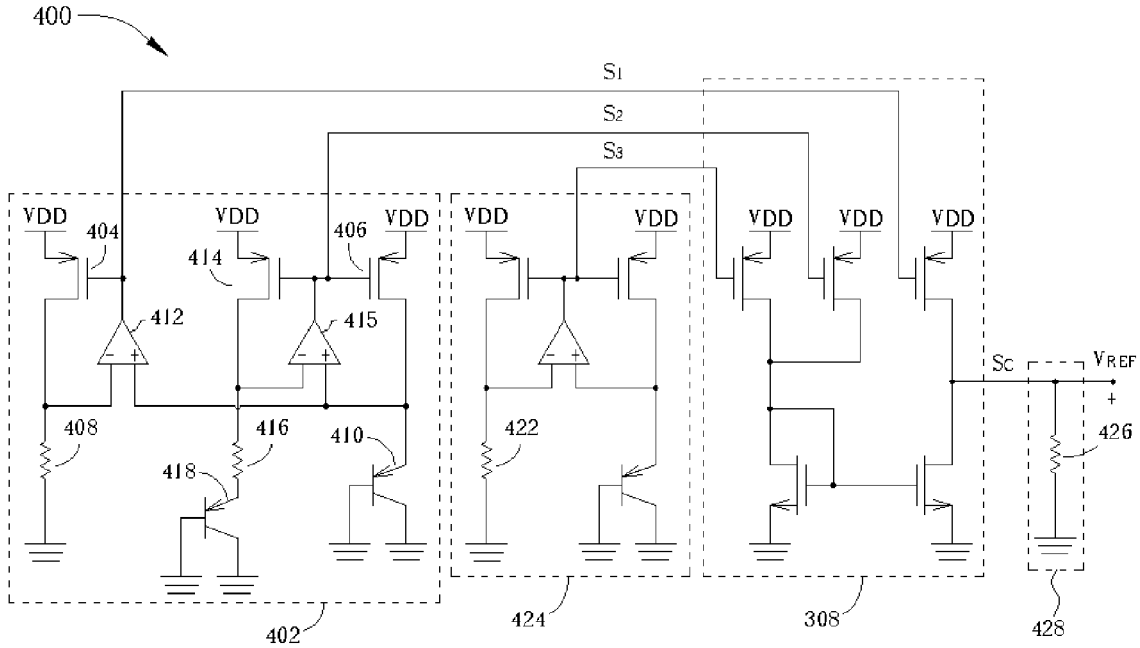
FIG. 4 shows a second circuit diagram for a $2^{nd}$ order compensated reference voltage generator according to a second embodiment of the present invention.

FIG. 4 shows a second circuit diagram for a $2^{nd}$ order compensated reference voltage generator 400 according to a second embodiment of the present invention. The reference voltage generator 400 shown in FIG. 4 includes similar components as the reference voltage generator 300 shown in FIG. 3; however, the reference voltage generator 400 shown in FIG. 4 includes first and second signals generators being merged together labeled 402. More specifically, the first signal generator includes a first PMOS transistor 404, a second PMOS transistor 406, a first resistor 408, a first bipolar transistor 410, and a first op-amp 412; and the second signal generator includes a third PMOS transistor 414, the second PMOS transistor 406, a second resistor 416, a second op-amp 415, the first bipolar transistor 410, and a second bipolar transistor 418. The components making up the first signal generator are connected in similar way as in FIG. 3. The components making up the second signal generator are similarly connected, except the second resistor 416 is connected to the emitter of the second bipolar transistor 418, which has its base and collector both tied to ground. In this way the first signal generator and the second signal generator share the second PMOS transistor 406 and the first bipolar transistor 410. Additionally, by connecting the second resistor 416 to a reference voltage being the emitter of the second bipolar transistor 418, which is at the base-emitter voltage $V_{BE}$ for the second bipolar transistor 418, it becomes easier to calculate the values for the resistors 408, 416, 420 in the signal generators 402, 424, and the output resistor 426 in the signal to voltage converter 428. In FIG. 4, the operation of the $2^{nd}$ order compensated reference voltage generator 400 is otherwise the same as described for FIG. 3.

Although pnp bipolar transistors have been used in the previous examples and diagrams, the present invention is not limited to pnp transistors, and it is possible to use npn transistors while still following the teachings of the present invention. Additionally, other temperature dependent characteristics, such as the current through a diode being dependent on the thermal voltage $V_T$ (dependent on temperature), can be used with the present invention. In general, by using N different devices, each device having a different temperature dependent characteristic, compensation to the $(N-1)^{th}$ order can be achieved.

Figure 5:
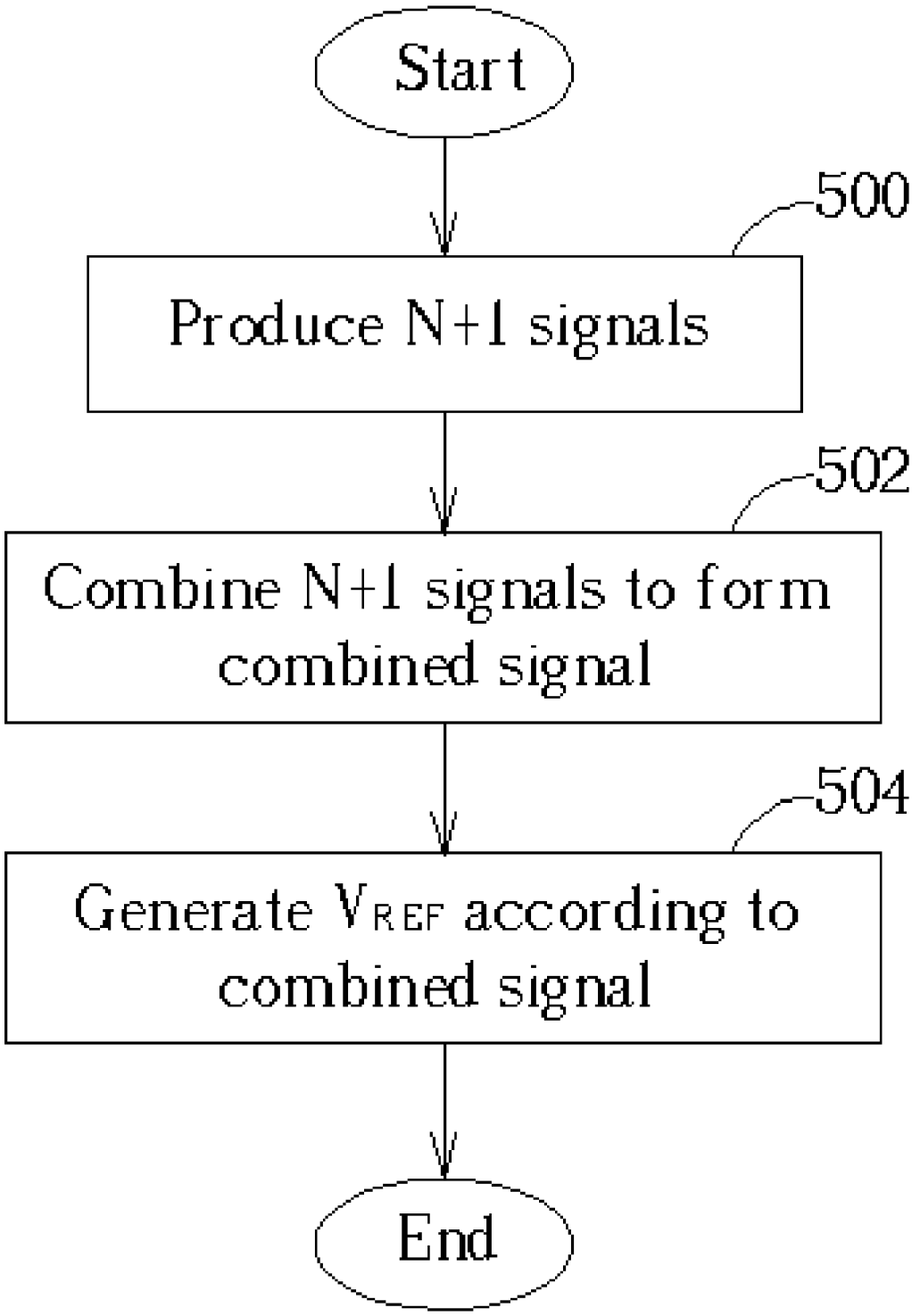
FIG. 5 is a flowchart illustration a method of generating an $N^{th}$ order compensated reference voltage according to the present invention.

As such, FIG. 5 is a flowchart illustrating a method of generating an $N^{th}$ order temperature compensated reference voltage according to an embodiment of the present invention. The flowchart in FIG. 5 contains the following steps:

Step 500: Produce N+1 signals being dependent on temperature. These signals can be produced according to N+1 base-emitter voltages of N+1 different bipolar transistors, or other temperature dependent characteristics.

Step 502: Combine the N+1 signals to form a combined signal. When combined, the N+1 signals must satisfy Equation (8), where r1 to $r_N$ are set to zero to achieve $N^{th}$ order compensation. In this way the thermal factors of the N+1 signals cancel out.

Step 504: Generate $V_{REF}$ according to the combined signal formed in Step 502.

According to the embodiments of the present invention, the value of the reference voltage $V_{REF}$ is determined according to the resistors used in the signal generators and the signal to voltage converter. In this way, reference voltage $V_{REF}$ feasible for low voltage applications, for example, sub 1.5V applications, can be generated. The present invention is therefore suitable for use in very low supply-voltage VDD circuits and produces a constant reference voltage having $N^{th}$ order temperature compensation.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A reference voltage generator having $N^{th}$ order temperature compensation comprising:

a plurality of signal generators for producing a plurality of signals respectively corresponding to a plurality of temperature dependent characteristics;

a combining module coupled to the signal generators for combining the plurality of signals to form a combined signal; and a signal to voltage converter coupled to the combining module for generating a compensated reference voltage according to the combined signal;

wherein the plurality of signals are N+1 temperature dependent signals, and N is at least 2.

2. The reference voltage generator of claim 1, wherein each signal generator comprises:

a first current source for providing a first current according to a control signal;

a second current source for providing a second current according to the control signal, the second current being substantially equal to the first current;

a resistor having a first node coupled to the first current source, the resistor for coupling the first current to a reference node;

a transistor having an emitter coupled to the second current source, and a base and a collector coupled to a supply node; and a control signal generator for generating the control signal to control the voltage at the first node of the resistor to be substantially equal to the voltage at the emitter of the transistor;

wherein the signal output by the signal generator is the control signal.

3. The reference voltage generator of claim 2, wherein the control signal generator is an operational amplifier (op-amp) having an inverting input terminal coupled to the first node of the resistor, and a non-inverting input terminal coupled to the emitter of the transistor, the output of the op-amp being the control signal.

4. The reference voltage generator of claim 2, wherein the combining module comprises a plurality of third current mirrors generating a plurality of third currents according to the plurality signals outputted by the signal generators, the third currents being electrically added or subtracted to form the combined, signal; and the signal to voltage converter comprises an output resistor coupling the combined signal to the supply node, the compensated reference voltage being the voltage across the output resistor.

5. The reference voltage generator of claim 1, wherein the combining module combines the plurality of signals to form the combined signal by arithmetically combining a plurality of currents according to the plurality of signals.

6. The reference voltage generator of claim 1, wherein the signal generators include a plurality of devices having p-n junctions, and each device has a specific temperature dependent characteristic corresponding to the voltage across a p-n junction.

7. The reference voltage generator of claim 6, wherein the devices are transistors and the temperature dependent characteristic is the base-emitter voltage.

8. A reference voltage generator having Nth order temperature compensation, where N is an integer equal to or larger than 2, the reference voltage generator comprising:

N+1 signal generators for producing a plurality of signals, wherein each of said produced signals possesses a temperature dependent characteristic;

a combining module coupled to the N+1 signal generators for combining the plurality of signals to form a combined signal; and a signal to voltage converter coupled to the combining module for generating an Nth order temperature compensated reference voltage according to the combined signal.

9. The reference voltage generator of claim 8, wherein the combining module combines the plurality of signals to form the combined signal by arithmetically combining a plurality of currents according to the plurality of signals.

10. The reference voltage generator of claim 8, wherein the signal generators include a plurality of devices having p-n junctions, and each device has a specific temperature dependent characteristic corresponding to the voltage across a p-n junction.

11. The reference voltage generator of claim 10, wherein the devices are transistors and the temperature dependent characteristic is the base-emitter voltage.

12. The reference voltage generator of claim 8, wherein each signal generator comprises:

a first current source for providing a first current according to a control signal;

a second current source for providing a second current according to the control signal, the second current being substantially equal to the first current;

a resistor having a first node coupled to the first current source, the resistor for coupling the first current to a reference node;

a transistor having an emitter coupled to the second current source, and a base and a collector coupled to a supply node; and a control signal generator for generating the control signal to control the voltage at the first node of the resistor to be substantially equal to the voltage at the emitter of the transistor;

wherein the signal output by the signal generator is the control signal.

13. The reference voltage generator of claim 12, wherein the control signal generator is an operational amplifier (op-amp) having an inverting input terminal coupled to the first node of the resistor, and a non-inverting input terminal coupled to the emitter of the transistor, the output of the op-amp being the control signal.

14. The reference voltage generator of claim 12, wherein the combining module comprises a plurality of third current mirrors generating a plurality of third currents according to the plurality signals outputted by the signal generators, the third currents being electrically added or subtracted to form the combined signal; and the signal to voltage converter comprises an output resistor coupling the combined signal to the supply node, the compensated reference voltage being the voltage across the output resistor.

15. A method for generating a reference voltage having $N^{th}$ order temperature compensation comprising:

producing a plurality of signals respectively corresponding to a plurality of temperature dependent characteristics;

combining the plurality of signals to form a combined signal; and generating a compensated reference voltage according to the combined signal;

wherein the plurality of signals are N+1 temperature dependent signals and N is at least 2.

16. The method of claim 15, further comprising providing a plurality of devices having p-n junctions, wherein each temperature dependent characteristic is the voltage across a p-n junction.

17. The method of claim 16, wherein the devices are transistors and the temperature dependent characteristic is the base-emitter voltage.

18. The method of claim 15, wherein the step of producing the plurality of signals further comprises providing a plurality of signal generators, each signal generator comprising:

a first current source for providing a first current according to a control signal;

a second current source for providing a second current according to the control signal, the second current being substantially equal to the first current;

a resistor having a first node coupled to the first current source, the resistor for coupling the first current to a reference node; and a transistor having an emitter coupled to the second current source, and a base and a collector coupled to a supply node; and the method hardier comprising, for each signal generator, generating the control signal such that the voltage at the first node of die resistor is substantially equal to the voltage at the emitter of the transistor;

wherein the N+1 signals are the control signals corresponding to each signal generator.

19. The method of claim 18, wherein for each signal generator, generating the control signal comprises providing an operational amplifier (op-amp) having an inverting input terminal coupled to the first node of the resistor, and a non-inverting input terminal coupled to the emitter of the transistor, the output of the op-amp being the control signal.

20. The method of claim 18, wherein combining the plurality of signals comprises providing a plurality of third current mirrors generating a plurality of third currents according to the plurality of signals, and electrically adding or subtracting the third currents to form the combined signal; and generating the compensated reference voltage comprises providing an output resistor coupling the combined signal to the supply node, the compensated reference voltage being the voltage across the output resistor.

21. The method of claim 15, wherein the combining step further comprising combining the plurality of signals to form the combined signal by arithmetically combining a plurality of currents according to the plurality of signals.

* * * * *